US005368688A

United States Patent [19]

Miki et al.

[11] Patent Number: 5,368,688

[45] Date of Patent: Nov. 29, 1994

[54] METHOD FOR BLEACHING PULP WITH OZONE WITH SUCCESSIVE STEPS OF LOWER CONSISTENCY

[75] Inventors: Kouhei Miki; Takuya Yamamoto; Yoshiko Shishido; Mitsuhiro Mieno, all of Kanagawa, Japan

[73] Assignee: Sumitomo Heavy Industries, Ltd., Japan

[21] Appl. No.: 62,176

[22] Filed: May 17, 1993

[30] Foreign Application Priority Data

Jul. 8, 1992 [JP] Japan ..... 4-180693

[51] Int. Cl.[5] ..... D21C 9/153; D21C 9/18

[52] U.S. Cl. ..... 162/56; 162/65

[58] Field of Search ..... 162/19, 62, 65, 243, 162/258, 56, 18, 60

[56] References Cited

U.S. PATENT DOCUMENTS 4,229,252 10/1980 Meredith ..... 162/65

FOREIGN PATENT DOCUMENTS 0520140 12/1972 European Pat. Off. ..... 162/65
52-6364 2/1977 Japan .
53-90403 8/1978 Japan .
54-30902 3/1979 Japan ..... 162/65
55-112390 8/1980 Japan .
56-43153 10/1981 Japan .
57-53916 11/1982 Japan .
1221587 9/1989 Japan .

*Primary Examiner*—Steve Alvo
*Attorney, Agent, or Firm*—Lorusso & Loud

[57] ABSTRACT

A method for bleaching pulp with ozone and, more specifically, to a method for bleaching pulp without deterioration of pulp quality. The starting material is a medium consistency pulp with easy handling during transfer and dewatering, namely, pulp of a consistency of about 10% by weight to 20% by weight. During the initial stage of the ozone bleaching process, the reaction velocity is maintained higher, while during the latter stage of the bleaching process, cellulose attack is prevented. Specifically, pulp bleaching is done with ozone, while the pulp consistency during the bleaching process is lowered in a stepwise manner within the range for a medium consistency pulp. The decreasing of the pulp consistency in a stepwise manner during the bleaching process involves bleaching a pulp of a consistency within the range of about 10 to 20% by weight with ozone, subsequently dewatering the pulp and then diluting the pulp with water to provide a pulp consistency lower than the pulp consistency before dewatering, repeating the cycle composed of the dehydration, the diluting and the ozone bleaching steps one or more times, whereby the pulp consistency is lowered within the range of medium consistency in a stepwise manner.

1 Claim, 1 Drawing Sheet

METHOD FOR BLEACHING PULP WITH OZONE WITH SUCCESSIVE STEPS OF LOWER CONSISTENCY

BACKGROUND OF THE INVENTION

The present invention relates to a method for bleaching pulp with ozone. More specifically, the present invention relates to a method for bleaching pulp without reducing pulp quality.

For pulp bleaching, primarily chlorine bleaches have been conventionally used. But it is becoming a matter of concern that environmentally hazardous organic chlorine compounds such as chlorinated dioxins are generated via the decomposition of the organic matters in pulp in chlorination stages. Compared with chlorine bleaching agents having such problems, ozone has a higher bleaching activity and does not generate hazardous substances. Accordingly, ozone has drawn attention for application to pulp bleaching.

In conventional pulp bleaching with ozone, the pulp consistency for contact with ozone has generally been a low pulp consistency such as 1 to 3% by weight pulp or a high pulp consistency such as 30 to 40% by weight pulp. A medium consistency pulp such as 8 to 20% by weight pulp has also been bleached with ozone. The process of bleaching this low consistency pulp with ozone is disclosed, for example, in Japanese Patent Publication No. Sho 53-28723.

It is believed that, when ozone is used for pulp bleaching, ozone induces the cleavage of the glycoside bonds in the cellulose chains, the principal pulp component, lowers the viscosity of bleached pulp and decreases the strength of the final products. To suppress cellulose attack during pulp bleaching with ozone, the following processes, for example, have been proposed.

One process for preventing ozone attack of cellulose involves pretreating pulp with a cellulose protector and subsequently bleaching the pulp with ozone, or bleaching pulp with ozone in the presence of a cellulose protector. Such conventional processes have been disclosed, for example, in Japanese Patent Publication No. Sho 52-6364, Japanese Patent Laid-open No. Sho 55-112390, Hei 1221587, and Sho 53-90403 and Japanese Patent Publication No. Sho 57-53916.

For example, Japanese Patent Publication No. Sho 56-43153 discloses a process of preventing ozone attack of cellulose by bleaching pulp of a higher concentration with ozone of a low concentration of 1 to 15 mg/liter.

For example, Japanese Patent Publication No. Sho 52-14329 discloses a process of preventing ozone attack of cellulose by bleaching pulp with ozone at a low temperature of 5° C. or less.

When a low consistency pulp is bleached with ozone, the reaction rate is slow because the reaction with ozone is via liquid phase, but with the advantage of less ozone attack of the cellulose. However, a low consistency pulp contains a vast amount of water, 97 to 99% by weight, which is costly to handle. Because of a higher water content in the pulp, ozone is more readily dissolved and decomposed in water, with the disadvantage of a lower efficiency of ozone consumption.

When a high consistency pulp is bleached with ozone, the reaction is generally considered to be a reaction between a gas phase and a solid phase, so that ozone directly reacts with the pulp at a high velocity. However, ozone attack of cellulose is distinctive, disadvantageously reducing the strength of the products.

Also, the dewatering is difficult, resulting in excessive cost.

The prevention of attack of cellulose, involving pretreating pulp with a cellulose protector and subsequently bleaching pulp with ozone or bleaching pulp with ozone in the presence of a cellulose protector, has a drawback in that the protector is costly.

Because the process of bleaching a high consistency pulp with a low concentration of ozone requires a concentration of ozone of about 1 to 15 mg/liter, the process disadvantageously requires a large amount of an ozone containing gas.

The aforementioned process of bleaching pulp with ozone at a low temperature of 5° C. or less has the drawback of costly cooling.

SUMMARY OF THE INVENTION

The present invention has been made in view of the problems described above. The objective of the present invention is to provide a process of bleaching pulp with ozone, which can solve the problems of the prior art and can prevent ozone attack of cellulose without using a cellulose protector and without requiring pulp cooling, wherein pulp dewatering can be readily carried out and the reaction velocity with ozone is adjusted to optimum so as to use ozone in an efficient manner.

In accordance with the present invention, therefore, a medium consistency pulp with easy handling during the transferring and dewatering steps is used as a starting material. The pulp consistency should be about 10 to 20% by weight. During the initial stage of the ozone bleaching process, the reaction rate should be maintained high, while during the latter stage of the bleaching process, cellulose attack should be prevented for bleaching. Specifically, the present invention is characterized in that pulp bleaching is done with ozone, while the pulp consistency during the bleaching process is lowered in a stepwise manner within the range of medium consistency.

In accordance with the present invention, ozone attack of cellulose can be prevented during the latter stage of bleaching while maintaining the ozone reaction efficiency at a high level during the initial stage of the ozone bleaching reaction. Therefore, bleaching corresponding to the ozone reactivity can be effected without adding a cellulose protector, in other words, by increasing the ozone reactivity during the initial stage of ozone bleaching while suppressing cellulose decomposition during the latter stage of ozone bleaching.

In accordance with the present invention, no pulp cooling or the like is required, so that a compact reactor can be used, while excellent bleaching activity is obtained.

In accordance with the present invention, water containing decomposed matter, which is capable of readily reacting further with ozone, can be removed by pulp dewatering. Thus, inefficient consumption of ozone can be reduced.

Because the starting material in the present invention is a medium consistency pulp, the transfer and dewatering of the pulp is relatively easy, with the advantage of lower cost.

DETAILED DESCRIPTION OF THE INVENTION

Figure 1:
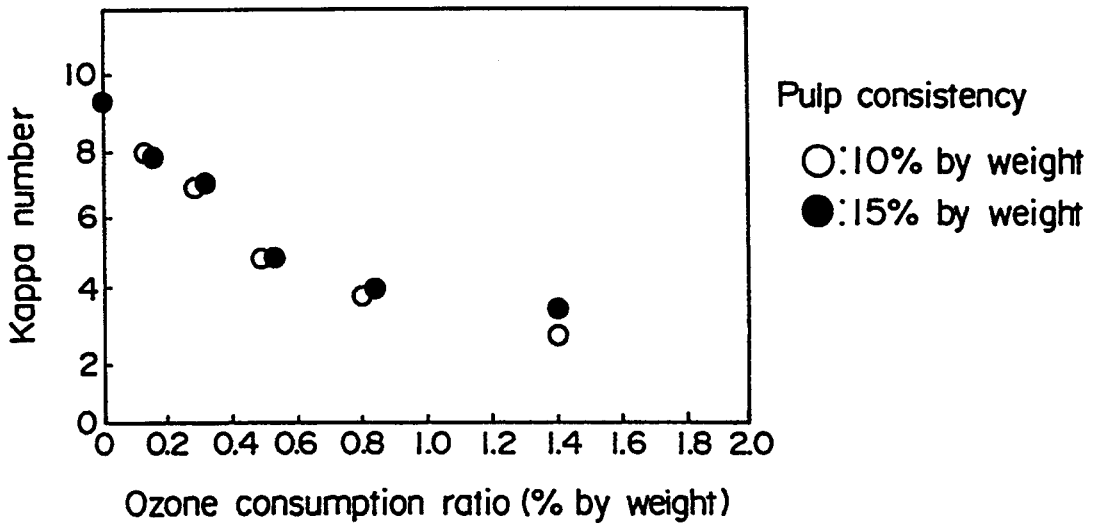
FIG. 1 is a graph showing the relationship between the Kappa number and the ozone consumption ratio with pulp consistencies of 10% by weight and 15% by weight.

According to a first aspect of the present invention, medium consistency pulp of about 10 to 20% by weight is used as a starting material. During the initial stage of the ozone bleaching process the reaction rate is maintained high and during the latter stage of the bleaching process cellulose attack is prevented while bleaching.

According to a second aspect of the present invention, medium consistency pulp of about 10 to 20% by weight is used as a starting material and the pulp concentration is decreased within the range of medium consistency in a stepwise manner.

According to a third aspect of the method for bleaching pulp with ozone, medium consistency pulp of about 10 to 20% by weight as a starting material is bleached with ozone, subsequently dewatered after bleaching, then diluted with water so that the pulp consistency is lower than the pulp consistency before dewatering, and then the diluted medium consistency pulp is again subjected to bleaching. The cycle composed of the dewatering, the diluting and the ozone bleaching steps is repeated one or more times, whereby the pulp consistency is lowered within the medium consistency range in a stepwise manner for bleaching.

The pulp starting material in the present invention is preferably a bleached or oxygen bleached pulp containing lignin.

The term "a medium consistency pulp" as used herein refers to a pulp consistency of about 8 to 20% by weight solids. The starting material to be used in the present invention is a medium consistency pulp being of a pulp consistency of about 10 to 20% by weight solids.

The reason why the pulp used in the present invention is limited to a medium consistency pulp is that such medium consistency pulp can be easily handled during the transfer and dewatering steps.

The inventors have discovered that the reaction rate with ozone depends on the pulp consistency in the case of medium consistency pulp; in other words, the reaction is promoted as the pulp consistency is increased while the reaction slows as the pulp consistency is decreased.

The bleachability of such medium consistency pulp with ozone is greater at a lower consistency than at a higher consistency.

The inventors have confirmed that during the initial stage of the ozone bleaching of pulp having a higher lignin content, a higher level of lignin removal can be obtained if the reaction rate with ozone is higher, namely, with an increased consistency of pulp.

The following Examples 1 and 2 report experiments supporting these findings.

EXAMPLE 1

An oxygen bleached kraft pulp of non-bleached broad-leaved tree (eucalyptus), having a Kappa number (value showing the lignin content of cellulose material) of 9.4, a brightness of 39.9%, and a viscosity of 29.1 cP1 was prepared with a pulp consistency of 10% by weight and 15% by weight. These samples were individually placed in 3.6-liter reactors with stirrers, into which was continuously charged aerated ozone of 2.1% by weight for bleaching.

The charging of the ozone was as follows: a gas flow rate of 2.0 Nl/ minute, a pulp charge amount of 300 g (bone dry), and a gas pressure of 0.2 kg/cm2 (gauge pressure). The reaction was terminated when the ozone consumption ratio (the weight of ozone consumed in the reactor per weight of bone dry pulp), reached 1.4% by weight. The brightness (%), Kappa number and viscosity (cP) were measured. These results are shown in Table 1. The pulp brightness was measured according to the Japanese Industrial Standard, JIS P8123-1961, which is shown as the specific reflection ratio of a sample to the standard magnesium oxide plate, when the sample is irradiated by the portion of the light spectrum corresponding to blue-violet.

TABLE 1

| | | |
|---|---|---|
| Ozone consumption ratio (% by weight) | 0~1.4 | 0~1.4 |
| Pulp consistency (% by weight) | 10 | 15 |
| Ozone reaction efficiency (%) | 50 | 72 |
| Kappa number | 2.5 | 3.3 |
| Brightness (%) | 65 | 64 |
| Viscosity (cP) | 17 | 14 |

The ozone reaction efficiency is a value defined by the following equation 1 with constant stirring when the ozone consumption ratio is between 0 to 1.4% by weight. Ozone reaction efficiency=(1−weight of ozone leaked from reactor during the reaction period/-weight of ozone supplied into reactor during reaction period)×100 . . . Equation 1.

Because the ozone reaction is carried out under the same conditions of aeration and stirring, the ozone reaction efficiency can be regarded as a value corresponding to the ozone reaction rate.

According to Table 1 above, the ozone reaction efficiency is higher at a pulp consistency of 15% by weight than at a pulp consistency of 10% by weight. Thus, it is found that the ozone reaction rate is faster when the pulp consistency is 15% by weight than 10% by weight.

As to the Kappa number, the number is lower at a pulp consistency of 10% by weight than at a pulp consistency of 15% by weight. Thus, lignin degradation is better at a pulp consistency of 10% by weight.

Furthermore, the viscosity is higher at a pulp consistency of 10% by weight than at a pulp consistency of 15% by weight.

Thus, the suppression of cellulose decomposition is better with a pulp consistency of 10% by weight.

EXAMPLE 2

Using the same pulp and reactor, with the same conditions, as in Example 1, while changing the ozone consumption ratio between 0 and 1.4% by weight, the Kappa number was measured corresponding to the ozone consumption ratio. FIG. 1 shows the relationship between the Kappa number and the ozone consumption ratio in the case of pulp consistency of 10% by weight and 15% by weight. In FIG. 1, white circles indicate the case where the pulp consistency was 10% by weight; black circles indicate the case where the pulp consistency was 15% by weight. FIG. 1 shows that within the range of ozone consumption ratio of 0 to 0.7% by weight, no difference in the Kappa number is found with a pulp consistency of 10% by weight or 15% by weight, and that above approximately 0.7% by weight of ozone consumption ratio, pulp can be bleached at a lower ozone consumption ratio at a pulp consistency of 10% by weight than at a pulp consistency of 15% by weight.

Based on the above Examples 1 and 2, the characteristics of the present invention will be explained as follows. During the initial stage of the pulp bleaching with ozone in accordance with the present invention, the ozone bleaching reaction is at a higher rate because use is made of a medium consistency pulp of a higher consistency. During the initial stage, however, the lignin content In the pulp is larger, so the ozone with a high lignin selectivity is mostly consumed by reaction with lignin, with the result that cellulose attack is not distinctive.

During the latter stage of the ozone bleaching process in accordance with the present invention, on the other hand, the lignin in pulp has already been decomposed by ozone, resulting in a lower lignin content. If the pulp is at a higher consistency during this latter stage, the ozone reaction proceeds at a higher rate, resulting in a higher ratio of ozone which can react with cellulose and decompose cellulose while leaving lignin, thus deteriorating the strength of the pulp product. Therefore, the reaction rate of pulp with ozone is slowed in the latter stages by adjusting the pulp consistency to a lower value, thereby suppressing cellulose decomposition and providing a higher reaction rate of lignin with ozone.

In accordance with the present invention, furthermore, the medium consistency pulp after the bleaching with ozone is subjected to dewatering, and subsequently the pulp is diluted with water so that the pulp consistency is lower than the consistency before dewatering, and the diluted medium consistency pulp is again subjected to bleaching. Herein, pulp bleaching with ozone generates decomposition matter from lignin and the like, which matter is contained in the water phase of the pulp. Thus, repetition of the ozone contacting step leads to ineffective consumption of ozone because ozone also reacts with such decomposition products. As has been described above in accordance with the present invention, the water can be removed by pulp dewatering, whereby the products of decomposition contained in the water are also removed. Thus, ozone can be more efficiently utilized.

EXAMPLE 3

An oxygen bleached kraft pulp of non-bleached broad-leaved tree (eucalyptus), Kappa number (value showing the lignin content of cellulose material) of 9.4, a brightness of 39.9%, and a viscosity of 29.1 cPl, was adjusted to a pulp consistency of 15% by weight. The raw material pulp was filled into a 3.6-liter first ozone bleaching reactor with a stirrer, into which was continuously charged aerated ozone of 2.1% by weight for bleaching. The conditions of ozone introduced were as follows: a gas flow rate of 2.0 Nl/minute, a pulp filling amount of 300 g (bone dry), and a gas pressure of 0.2 kg/cm2 (gauge pressure). The reaction was terminated when the ozone consumption ratio (the weight of ozone consumed in the reactor per weight of bone dry pulp), reached 0.7% by weight.

The pulp was removed from the reactor and was dewatered to a consistency of about 20% by weight, followed by addition of distilled water to adjust the pulp to a consistency of 10% by weight. The pulp was then returned into the reactor, followed by bleaching. Ozone was consumed until the ozone consumption ratio was 1.4% by weight.

The Kappa number, brightness and viscosity of the resulting pulp are shown in Table 2. The ozone reaction efficiency in Table 2 was calculated at time intervals when the ozone consumption ratios were between 0 to 0.7% by weight and between 0.7 to 1.4% by weight, according to the definition as in Example 1 above.

TABLE 2

| | | |
|---|---|---|
| Ozone consumption ratio (% by weight) | 0~0.7 | 0~0.7 |
| Pulp consistency (% by weight) | 15 | 10 |
| Ozone reaction efficiency (%) | 88 | 41 |
| Kappa number | 2.2 | |
| Brightness (%) | 66 | |
| Viscosity (cP) | 17 | |

As seen in Table 2, the mean value of ozone reaction efficiency during the initial stage of the ozone bleaching process and during the latter stage of the ozone bleaching process were larger than those in the case of the pulp bleaching process with ozone at a pulp consistency of 10% by weight (Example 1).

The Kappa number, the brightness, and the viscosity of the present Example closely resemble those values obtained in pulp bleaching with ozone at a pulp consistency of 10% by weight in Example 1.

Thus it is found that the method of the present invention is capable of maintaining a higher ozone reaction efficiency during the initial stage of the ozone bleaching process, and preventing cellulose attack during the latter stage of the bleaching process.

While the present invention has been described above in detail, it should not be considered limited to the Examples described above. Various modifications thereof are possible. For the practice of the present invention, for example, an increase or decrease in the ozone consumption ratio is possible under the conditions satisfying the required bleaching degree. As to the pulp consistency of the raw material, use can be made of pulp within the range of medium consistency, preferably using a pulp of 10 to 20% by weight.

Prior to or after the ozone bleaching in accordance with the present invention, bleaching with hydrogen peroxide or chlorine compounds may be added if necessary.

We claim:

1. A method for bleaching a medium consistency pulp with ozone, said medium consistency pulp containing lignin and initially having a consistency within a range of 10 to 20% by weight solids, said method comprising:

a) contacting ozone with the medium consistency pulp to reduce the lignin content of the medium consistency pulp;

b) subsequent to said contacting with ozone, dewatering said pulp to separate therefrom water containing degradation products formed by action of said ozone on said pulp;

c) subsequent to said dewatering, diluting said pulp to a consistency within said range lower than the consistency of the pulp in the last preceding step a;

d) repeating steps a, b and c with each step a operating on a medium consistency pulp within said range and having a lower consistency than that in the last preceding step a;

whereby in each successive ozone contacting step a the reaction rate for the reaction of ozone with the lignin is less than that in the preceding ozone contacting step, said method avoiding cellulose decomposition by reaction with ozone and using no cellulose protector.

* * * * *